United States Patent [19]

Titus et al.

[11] 3,960,324

[45] June 1, 1976

[54] METHOD FOR GENERATION OF MULTIPLE UNIFORM FLUID FILAMENTS

[75] Inventors: Donald E. Titus, Endicott; Sherman H. M. Tsao, Apalachin, both of N.Y.

[73] Assignee: International Business Machines Corporation, Armonk, N.Y.

[22] Filed: May 29, 1975

[21] Appl. No.: 582,065

Related U.S. Application Data

[62] Division of Ser. No. 432,260, Jan. 10, 1974, Pat. No. 3,900,162.

[52] U.S. Cl. ..... 239/4

[51] Int. Cl.[2] ..... B05B 17/06

[58] Field of Search ..... 239/4, 101, 102; 346/75

[56] References Cited

UNITED STATES PATENTS

| | | | |
|---|---|---|---|
| 3,211,088 | 10/1965 | Naiman | 239/102 X |
| 3,373,437 | 3/1968 | Sweet et al. | 239/4 X |
| 3,747,120 | 7/1973 | Stemme | 346/75 |
| 3,877,036 | 4/1975 | Loeffler | 346/75 |

*Primary Examiner*—John J. Love

*Attorney, Agent, or Firm*—Kenneth P. Johnson

[57] ABSTRACT

Method and apparatus for generating a plurality of parallel droplet streams in a coating apparatus, such as an ink jet printing device, in which the streams break into droplets from fluid filaments at a uniform distance from issuing orifices. The streams issue from a pressurized chamber in which an elastic bending member is repetitively flexed by a plurality of parallel bending elements operated simultaneously to produce uniform bending throughout the effective length of said member to produce successive pressure disturbances within the supply chamber and induce varicosities of the same size and frequency in the issuing streams. This arrangement is able to enhance printing quality in an ink jet recorder by permitting maintenance of proper phase relationship between droplet formation and charging voltage.

6 Claims, 8 Drawing Figures

METHOD FOR GENERATION OF MULTIPLE UNIFORM FLUID FILAMENTS

This is a division of application Ser. No. 432,260 filed Jan. 10, 1974, now U.S. Pat. No. 3,900,162.

BACKGROUND OF THE INVENTION

This invention relates generally to fluid droplet generation and more particularly to the generation of parallel fluid droplet streams in which the streams change from filaments to droplets at the same distance from the issuing orifices.

In the construction of ink jet recorders having a plurality of parallel recording streams of uniform velocities that are to each pass in charging relationship with a charging electrode, there is difficulty encountered in attempting to maintain the integrity of each stream as a filament to the same distance from the issuing orifice so that the streams break into droplets at the same point and time. The droplets are selectively charged at the point of breakoff from the filament and subsequently deflected along a desired trajectory downstream by electrostatic deflection plates. Deflected droplets may be either recorded or discarded depending on the printing mode. When the transition point from filament to droplet changes, then the droplet does not form with the proper charge and hence is not deflected to the desired impact point. The unpredictability of the drop breakoff point is especially troublesome in multi-jet printheads where it is highly desirable that the printing or non-printing of the plurality of jets in a row operate in synchronism.

Usually a single ultrasonic transducer is used to produce pressure variations within ink supply chamber or manifold so that the difficulty is not with the synchronization of two or more transducers. When a single vibrating transducer is used to stimulate drop formation, however, acoustical waves of generally varying intensity are present at the issuing orifices. Thus, the filament lengths vary directly with the intensity of the stimulating pressure waves.

In the past, an attempt has been made to maintain uniform stimulating pressure waves throughout the length of a row of orifices by mounting the transducer at one end of the row of orifices so that the bending wave resulting from the vibrating transducer is propogated along the length of the plate. The ends of the plate are damped to inhibit vibrational reflections and maintain a relatively pure stimulation disturbance. With this technique, the filament lengths become more nearly uniform but there still remains a difference between the length of filaments nearest the transducer and those farthest away. The more remote filaments tend to be longer in length resulting in delayed drop formation and irregular charging.

It is accordingly a general object of this invention to provide an ink jet recorder of improved reliability and quality.

Another important object of this invention is to provide an ink jet recorder in which the lengths of parallel filaments issuing from jet orifices are more nearly uniform so that droplets form at each filament at approximately the same time and same distance from the orifices.

A still further object of this invention is to provide an ink jet manifold with a vibrational transducer arranged therein such that in operation uniform stimulating pressure changes are transmitted simultaneously to all issuing orifices.

Another object of this invention is to provide an ink jet manifold for issuing plurality of parallel fluid filaments having varicosities induced therein by a vibrating member in the supply chamber which is operated in conjunction with a specially shaped chamber to increase the effective amplitude of the generated acoustic waves.

SUMMARY OF THE INVENTION

The foregoing objects are attained in accordance with the principles of the invention by providing within a pressurized ink supply manifold having a linear array of stream-issuing orifices, a flexible elastic bending member which is freely permitted to bend about a single axis. A plurality of piezoelectric transducers are secured in a common orientation to one side of the bending member and all transducers are energized simultaneously from a common potential source to produce simultaneous bending of the member along its length. The member is preferably coextensive with the length of the manifold and parallel to the linear array of orifices through which pressurized ink is forced in parallel streams. The bending member has a spaced pair of slits cut therein to provide a free boundary for the bending member and permit more uniform movement of the bending portion. In the preferred embodiment, the bending member separates the manifold cavity into two compartments, each specially formed to concentrate pressure waves created by the bending member at the two converging extremities of the compartments.

The invention has the advantage of being capable of producing a bending wave of uniform intensity along its length and along a linear array of nozzles when the bending member is parallel therewith. Thus, the fluid issuing from the orifices can be subjected to a series of pressure waves of uniform amplitude so that nearly identical varicosities are induced in each stream at the same time. Because of this, the phase relationship between charging voltages for the several streams and the drop formation is easier to maintain. This results in improved printing quality since better registration of droplet impact is possible.

The foregoing and other objects, features and advantages of the invention will be apparent from the following more particular description of preferred embodiments of the invention as illustrated in the accompanying drawings.

DESCRIPTION OF THE PREFERRED EMBODIMENTS

Figure 1:
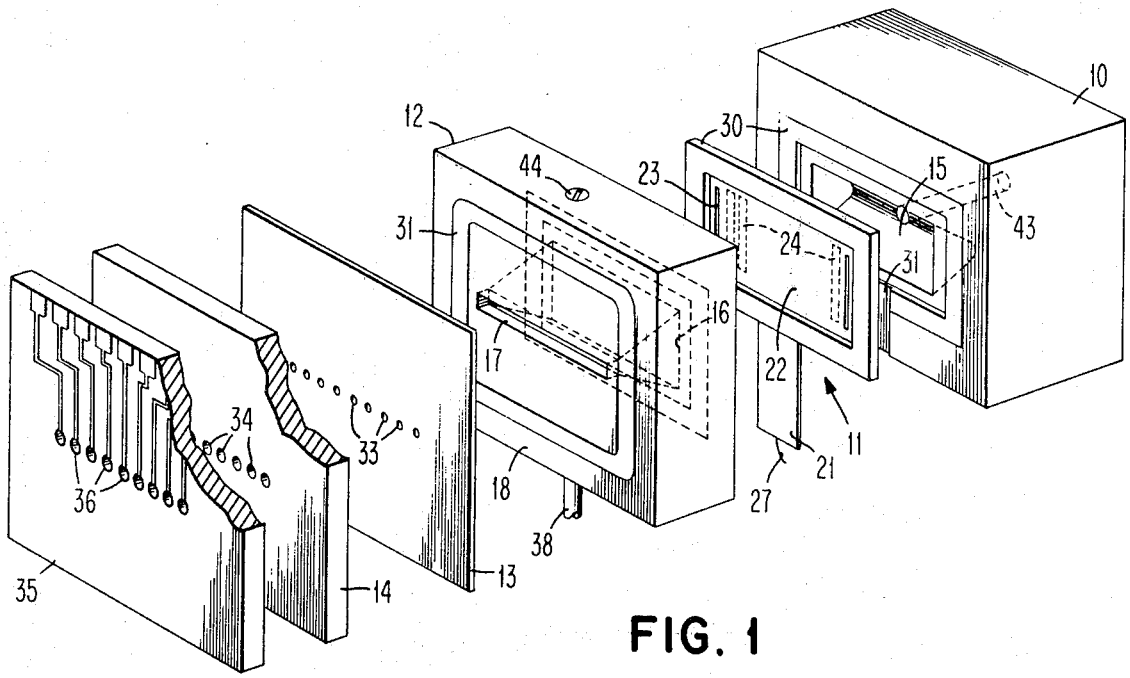
FIG. 1 is an exploded view of a marking head constructed in accordance with the principles of the invention.
Figure 3:
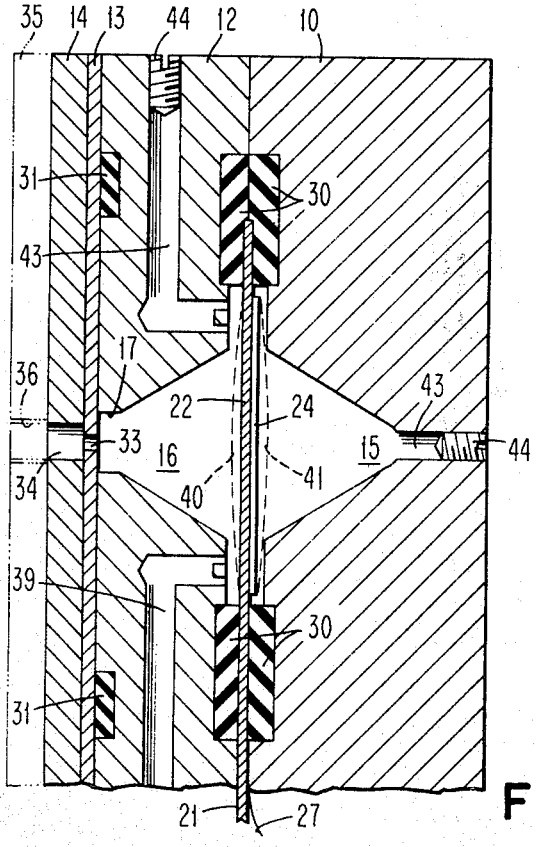
FIG. 3 is a sectional elevation view of the marking head taken along the lines 3—3 in FIG. 2.
Figure 2:
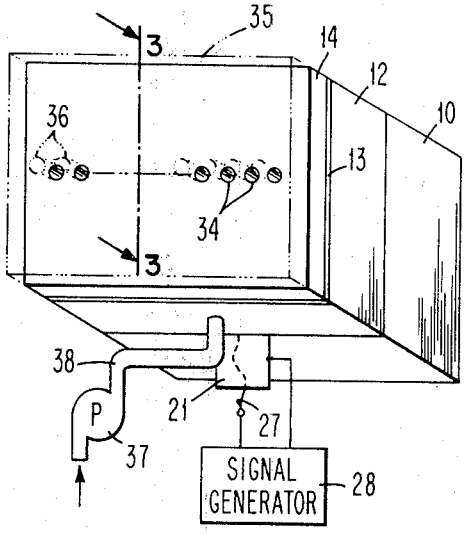
FIG. 2 is a perspective view of the marking head of FIG. 1 when assembled.

Referring to FIGS. 1, 2 and 3, a marking head constructed in accordance with the invention comprises generally a rear cavity block 10, a vibrational bending member 11, a front cavity block 12, an orifice plate 13, an insulative element 14, and a charging plate 35. Block 10 is formed with a rear converging cavity 15 while cavity 16 in block 12 is forwardly converging. When the two cavity blocks are secured together about member 11, there is formed a substantially diamond-shaped chamber which serves as a manifold for plurality of marking fluid orifices. Cavity 16 extends through block 12 and forms a slot 17 in the front surface 18 of the block. Intermediate blocks 10 and 12 is a vibratory bending member 11 of a thin, flexible, elastic material such as stainless steel having a thickness of approximately 5 mils. The depth of each cavity 15 and 16 is preferably one quarter of the wave length of the operating frequency of bending member 11. This depth produces a standing wave at each cavity extremity.

Figure 4A:
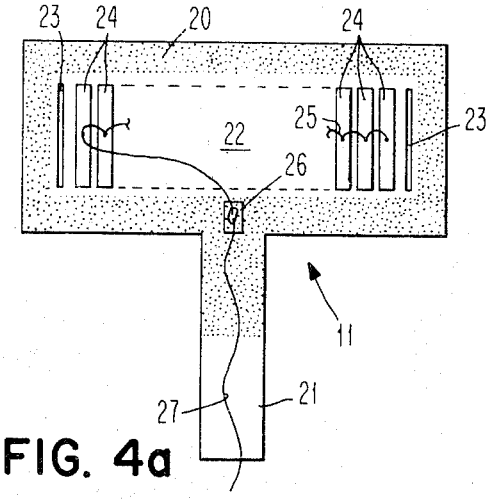
FIG. 4 is a rear elevation view of the vibrational bending member shown in FIGS. 1 and 3.
Figure 4B:
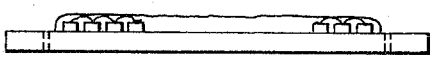

Bending member 11 is shown in greater detail in FIG. 4. The bending member is generally rectangular and of sufficient size to be secured between blocks 10 and 12 and divide the manifold cavity into the front and rear compartments 15 and 16. The member comprises generally a shaded marginal portion 20 which is gripped between the cavity blocks, and a similarly secured tab portion 21 of sufficient length to extend beyond the outside edges of blocks 10 and 12 when assembled together. A central vibratory portion 22 of the bending member is cut free of the member proper by two slits 23 extending through the thickness of the member. This permits the vibratory center portion 22 to be free at its ends.

On one side of bending member 11 between slits 23 is placed a plurality of transducers, preferably piezoelectric strips of a material such as barium titanate. These strips are cut with a length to width ratio varying from approximately 4:1 to 6:1 and have a thickness of approximately 10 mils. The length of the transducer strips 24 is preferably approximately the length of the slits 23 which can in turn vary according to the amount of bending deflection desired within cavity compartments 15 and 16. The piezoelectric material is preferably selected for maximum bending. As is shown in FIG. 3, transducer strips 24 extend beyond the upper and lower limits of compartments 15 and 16 but may be shortened to less than the edges of the compartments proper adjacent bending member 11. The relatively large length to width ratio is desirable for the piezoelectric strips in order to maximize bending of central portion 22 about its longitudinal axis. The piezoelectric material is mounted for expansion in the thickness mode only and when energized will tend to bend in a dish-shaped manner. The narrow width of each transducer finger tends to minimize the effect of the dishing and thus produce single axis bending.

Transducer strips 24 are secured to central portion 22 of bending member 11 by an adhesive such as a bonding epoxy. The number and spacing of the transducer fingers 24 will be determined, as mentioned above, by the required deflection of central portion 22 to effect the necessary pressure waves within the issuing fluid. Transducer fingers 24 are mounted with the same orientation, of course, so that all transducers when energized will effect a bending force in unison on central portion 22. The transducers should be evenly spaced and parallel to relief slots 23. After the transducer fingers have been mounted to element 11, the voids between the fingers are filled with a suitable adhesive such as epoxy. Thereafter, each of the fingers is electrically connected via a conductor 25 soldered to the exposed outside surface of each of the fingers and to a terminal block 26. The terminal block is secured with a suitable insulative adhesive to bending member 11. At terminal block 26, an insulated conductor 27 is connected with the wire 25 and secured with an adhesive along tab 21. Thereafter, transducers 24 and wire 25 are coated with an insulative protective material which serves also as a moisture seal. A polyurethane or other suitable material may be used.

Bending member 11 with transducer fingers 24 thereon is mounted between cavity blocks 10 and 12 using a pair of gaskets 30 as shown in FIGS. 1 and 3. A recess 31 is preferably provided in one of the cavity blocks such as block 10 to allow tab portion 21 of bending member 11 and conductor 27 to extend below the lower surface of the block for attachment to suitable electrical signal generating source 28, such as a sinewave generator. By using a conductive bending element and adhesive for mounting fingers 24, the energizing circuit is simplified. Blocks 10 and 12 are preferably secured together with screws placed so as to prevent leakage of a pressurized fluid within the cavity. Orifice plate 13 is secured to the rear surface of insulative element 14 with an adhesive and both are then secured to front surface 18 of cavity block 12 with suitable means such as screws (not shown). A gasket 31 is used to provide a seal. Thereafter, insulative plate element 14 with openings 34 aligned with orifices 33 is secured to orifice plate 13. The insulative element 14 is used to allow subsequent attachment of charging plate 35 containing charge rings 36 with which fluid droplets can be selectively charged as they break off from filaments extending from orifices 33. Orifices may range in size from 0.5 to 1.5 mils in diameter while holes 34 are larger, such as 6 to 8 mils.

After the marking head has been assembled, it is connected to a suitable pressurized ink supply as indicated by pump 37 and duct 38 which are connected with inlet opening 38 that communicates along a groove with cavities 15 and 16 as shown in FIG. 3. Vents 43 with stoppers 44 permit bleeding off of air during charging. Since the two cavities are interconnected by slits in bending member 22, the manifold is equally pressurized in both compartments providing balanced static pressures. Tab portion 21 of bending member 11 and the conductor 27 extending beyond the bottom of the marking head are connected across the signal source sinewave generator 28, that is capable of applying an actuating signal, for example, from 60 to 120 Khz, to piezoelectric transducer fingers 24.

As pressurized ink is forced from the linear array of orifices 33, the pulses applied to piezoelectric transducers 24 cause central portion 22 of the bending element to deflect to a position such as shown by dotted line 40 in FIG. 3. The signal generator may operate between ground and some voltage or be connected so as to operate as voltage swings about the ground level. If the latter condition is used then, of course, bending member deflection will be between the pair of dotted lines 40 and 41. The energization of transducers 24, by causing central portion 22 to repetitively flex sets up pressure waves within converging compartments 15 and 16 causing the ink at each of the orifices to experience a change in pressure simultaneously along the orifice array. This causes the occurrence of varicosities in the fluid filament issuing from each orifice which results in the formation of droplets in each stream at the same distance from orifice plate 13.

Figure 5A:
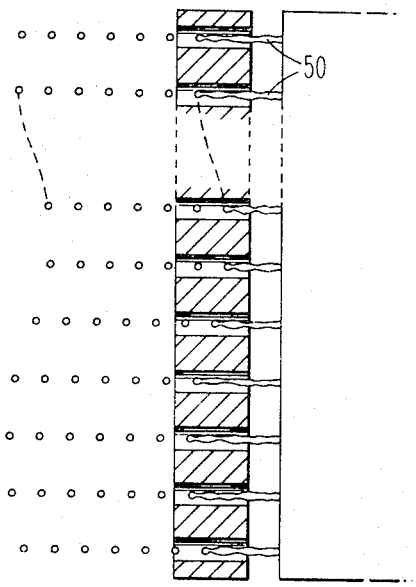
FIGS. 5*a* and 5*b* are schematic diagrams comparing streams issuing from a conventional marking head and one which incorporates the invention.
Figure 5B:
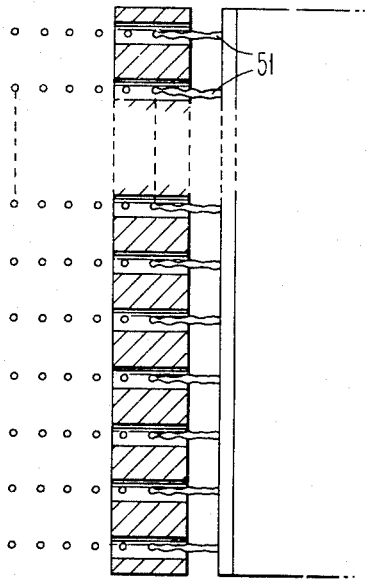

Referring to FIGS. 5*a* and *b*, there is illustrated for comparative purposes a schematic representation of droplets formed by prior art, vibratory devices and those formed with structure assembled in accordance with the invention. It will be noted that fluid streams 50 issuing from the orifice plate, FIG. 5*a* as in the prior art tend to break up at a varying distance from the orifice plate within the charge plate. The breakup for the filaments into droplets occurs usually in a pattern which is reflective of the variations in wave intensity at the orifice plate and along the orifice array direction. When the vibratory element 11 as disclosed above is used within the ink manifold, each fluid filament 51 has induced therein at the same time and with the same magnitude a pressure variation which results in similar varicosities occurring along each filament as it issues from the orifice. This has the advantage of resulting in droplet breakoff at the same point and time within the charge plate. By using the latter structure, much of the difficulty in maintaining the proper phase relationship in both time and space between corresponding drops of the array of filaments is obviated with the result that droplets are more accurately registered on a recording surface.

Figure 6:
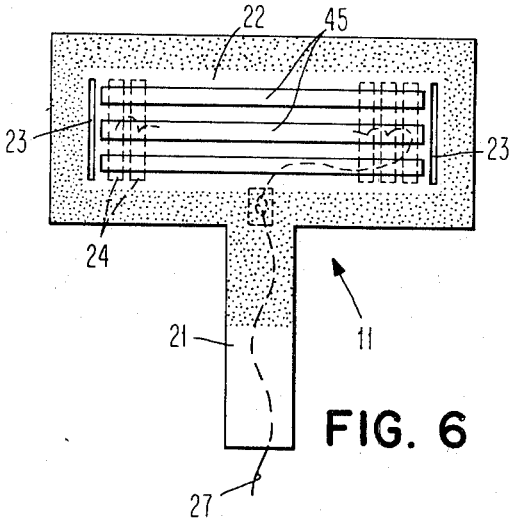
FIG. 6 is a front elevation view of an alternative embodiment of the bending member shown in FIG. 4.

In FIG. 6 there is shown a modification of bending element 11 in which stiffening bars 45 are added transversely of transducer fingers 24 and on the opposite side of central flexing portion 22. The stiffening bars are optional and used only if portion 22 tends to bend transversely of the desired bending. Bars 45 may be adhesively secured to element 11. Also, the bars may be replaced with a corrugated shim stock to accomplish the same result. The preferred material is stainless steel in either case so as to prevent corrosion. Other metals, however, may be used if desired.

Although bending element 11 has been shown secured on all edges about the flexing portion 22, it can be secured only along opposite edges or along a single edge, preferably an edge parallel to the bending axis.

While the invention has been particularly shown and described with reference to preferred embodiments thereof, it will be understood by those skilled in the art that the foregoing and other changes in form and details may be made therein without departing from the spirit and scope of the invention.

What is claimed is:

1. The method of generating droplets of fluid comprising the steps of:

producing a set of fluid filaments by forcing a fluid simultaneously through an array of orifices spaced along a fixed plate in a cavity; and breaking said filaments up into droplets by successively generating a single uniform drop stimulating pressure wave by simultaneous actuation of a plurality of bending elements on a bending member in said cavity.

2. The method of generating fluid droplets comprising the steps of:

providing a cavity having a row of nozzles along one wall thereof;

supplying pressurized fluid to said cavity to produce a plurality of simultaneously issuing streams of fluid from said cavity;

generating pressure disturbances in said cavity by simultaneous energization of a plurality of deformable elements on a bending member.

3. The method as described in claim 2 wherein said plurality of deformable elements bend said member along an axis parallel with said row of nozzles.

4. A method as described in claim 2 wherein said pressure disturbances are generated at a constant frequency.

5. The method as described in claim 2 wherein the bending of said member occurs about an axis parallel to said row of nozzles.

6. The method of generating droplets of liquid in a plurality of streams comprising the steps of:

producing a set of liquid filaments by forcing a liquid simultaneously through a row of orifices in a wall of a cavity; and causing said filaments to break into droplets by successively generating a single, uniform, drop-stimulating pressure wave by simultaneous actuation of a plurality of deformable elements for bending a member about an axis in said cavity.

* * * * *